US005430367A

United States Patent [19]

Whitlock et al.

[11] Patent Number: 5,430,367

[45] Date of Patent: Jul. 4, 1995

[54] SELF-REGULATING BAND-GAP VOLTAGE REGULATOR

[75] Inventors: William P. Whitlock, Cicero; Mark B. Kearney, Kokomo, both of Ind.

[73] Assignee: Delco Electronics Corporation, Kokomo, Ind.

[21] Appl. No.: 6,290

[22] Filed: Jan. 19, 1993

[51] Int. Cl.[6] ..... G05F 3/16

[52] U.S. Cl. ..... 323/313; 323/281; 323/907

[58] Field of Search ..... 323/313, 907, 280, 281, 323/312, 314; 307/310

[56] References Cited

U.S. PATENT DOCUMENTS

| | | | |
|---|---|---|---|
| 3,887,863 | 6/1975 | Brokaw | 323/19 |
| 4,287,439 | 9/1981 | Leuschner | 307/310 |
| 4,380,728 | 4/1983 | Kearney | 323/281 |
| 4,792,748 | 12/1988 | Thomas et al. | 323/312 |
| 5,148,099 | 9/1994 | Ong | 323/314 |

OTHER PUBLICATIONS

"The Art of Electronics" Second Edition; Paul Horowitz and Winfield Hill; Cambridge University Press (1989) pp. 335–338.

*Primary Examiner*—Thomas M. Dougherty
*Assistant Examiner*—Adolf Berhane
*Attorney, Agent, or Firm*—Mark A. Navarre; Jimmy L. Funke

[57] ABSTRACT

A band-gap voltage regulator having a self-regulating characteristic which improves the operation of the regulator includes a feedback circuit coupling a gain stage of the regulator to a voltage reference circuit which influences the regulated voltage. Changes in the operation of the gain stage which would otherwise change the regulated voltage produce counteracting changes in the voltage reference circuit, causing the supply voltage to remain substantially constant.

3 Claims, 1 Drawing Sheet

SELF-REGULATING BAND-GAP VOLTAGE REGULATOR

This invention relates to voltage regulators based on a band-gap voltage reference, and more particularly, to an internal feedback arrangement for providing improved voltage regulation.

BACKGROUND OF THE INVENTION

Voltage regulators based on the energy band-gap voltage of a semiconductor material have been used in applications requiring temperature-stable operation. A band-gap voltage reference circuit provides a positive temperature coefficient (PTC) reference voltage, which when added to a negative temperature coefficient (NTC) reference voltage of proper magnitude, produces an overall reference voltage having a zero temperature coefficient (ZTC) characteristic. The PTC reference voltage is based on the emitter-base voltage differential ($\Delta V_{BE}$) between a pair of current mirror transistors having different current densities. The NTC reference voltage is developed by the base-emitter voltages of one or more output transistors which operate to regulate a supply voltage at a level determined in relation to the overall reference voltage.

A shortcoming of the above-described ZTC voltage regulator is that the NTC reference voltage tends to vary with current density of the output transistors. This, in turn, varies the overall reference voltage, reducing the ability of the circuit to precisely regulate the supply voltage.

SUMMARY OF THE PRESENT INVENTION

The present invention is directed to an improved band-gap voltage regulator having a self-regulating characteristic which improves the operation of the regulator. In addition to the usual first and second current paths through the current mirror transistors, the PTC circuit of the present invention includes a third current path referenced to the $V_{BE}$ of one of the current mirror transistors, thereby developing a constant intermediate potential which nominally corresponds to an intermediate potential of the NTC circuit. A feedback circuit couples the two intermediate potentials so that changes in the operation of the output transistors which change the NTC reference voltage produce counteracting changes in the current supplied to the third current path of the PTC circuit, causing the supply voltage to remain substantially constant.

BRIEF DESCRIPTION OF THE DRAWINGS

The single drawing FIGURE depicts a circuit diagram of a self-regulating voltage regulator according to the preferred embodiment of this invention.

DETAILED DESCRIPTION OF THE INVENTION

Figure 1:
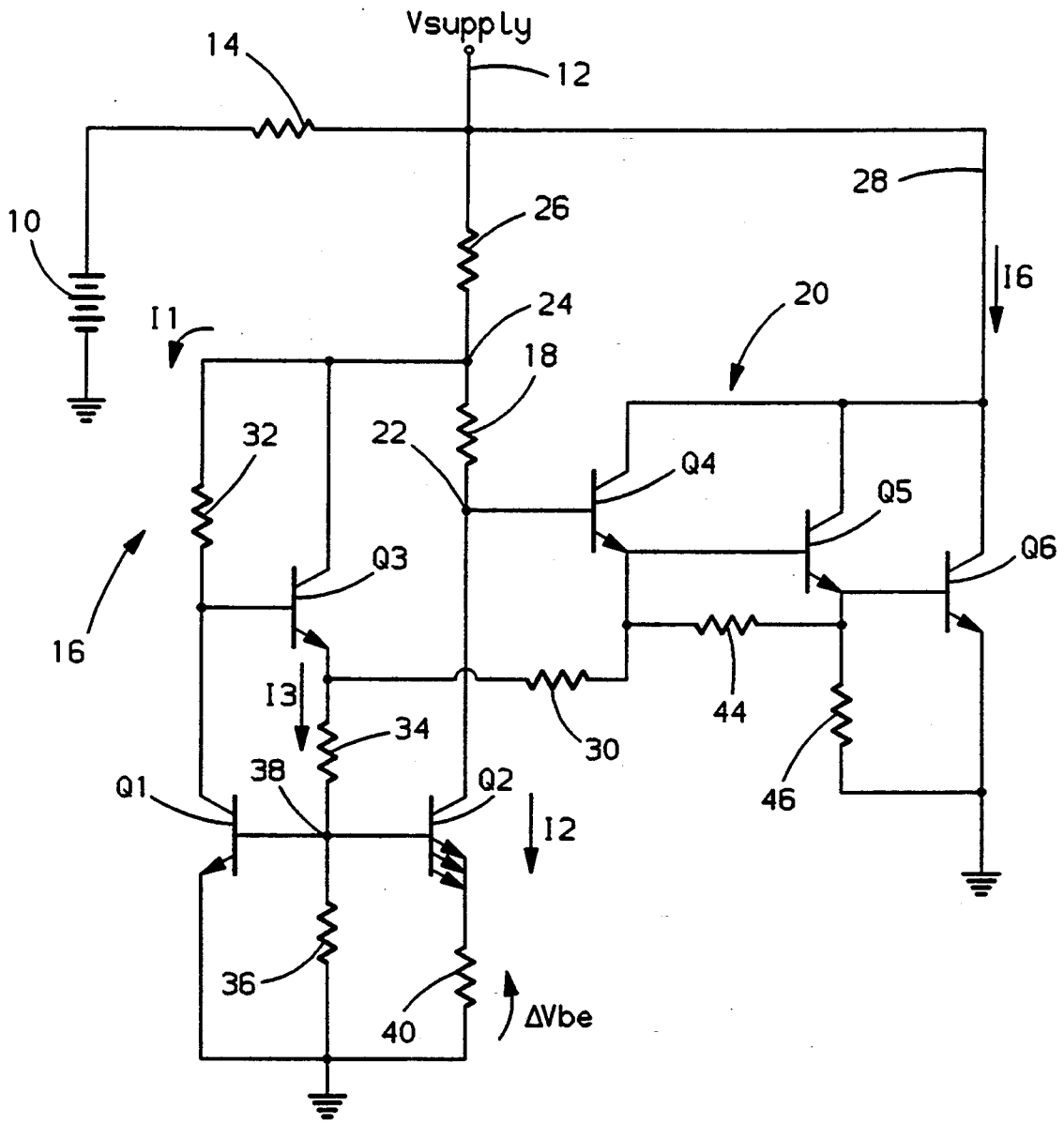

Referring to the single drawing FIGURE, a source of unregulated DC voltage, such as the storage battery 10, supplies a supply voltage Vsupply to terminal 12 via resistor 14. As explained below, a PTC circuit 16 develops a PTC reference voltage across a resistor 18, and a NTC circuit 20 develops a NTC reference voltage with respect to ground at the lower terminal 22 of resistor 18. The PTC and NTC reference voltages add at terminal 24 to form an overall ZTC reference voltage Vref, the terminal 24 being connected to the supply voltage terminal 12 via resistor 26.

The NTC circuit 20 is also coupled to the supply voltage terminal 12, and conducts current I6 through line 28 as required to regulate the supply voltage Vsupply in accordance with the sum of Vref and the voltage across resistor 26. As also described below, a feedback resistor 30 couples NTC circuit 20 to PTC circuit 16 to enhance the regulation of supply voltage Vsupply.

The PTC circuit 16 is connected to the terminal 24 and comprises a first leg including resistor 32 and the collector-emitter circuit of a first current mirror transistor Q1; a second leg including the resistor 18, the collector-emitter circuit of a second current mirror transistor Q2 and resistor 40; and a third leg including the collector-emitter circuit of bias transistor Q3 and resistors 34 and 36. The base terminals of current mirror transistors Q1 and Q2 are mutually connected to the junction 38 of resistors 34 and 36, the transistor Q2 having a current density which is relatively low compared to transistor Q1.

Due to the differential current densities of current mirror transistors Q1 and Q2, and the supply of a constant current I1 to transistor Q1, the emitter-base voltage differential $\Delta V_{BE}$ between transistors Q1 and Q2 will be constant, and will exhibit a PTC characteristic. That is, $\Delta V_{BE}$ will increase with increasing temperature and decrease with decreasing temperature. The voltage differential $\Delta V_{BE}$ appears across resistor 40, resulting in a constant current I2 that also has a PTC characteristic. Neglecting the base drive current of NTC circuit 20, the PTC current I2 thereby produces a PTC reference voltage in resistor 18.

The current I3 in the third leg of PTC circuit 16 is also substantially constant, neglecting base currents and the effects of feedback resistor 30, due to the constant $V_{BE}$ voltage impressed across resistor 36 by transistor Q1. Significantly, the resistor 34 is identical in value to resistor 36, resulting in a constant voltage of 2 $V_{BE}$ at the emitter of transistor Q3.

The NTC circuit 20 comprises a set of three cascaded transistors Q4, Q5 and Q6 connected in a Darlington configuration. Thus, the emitter of transistor Q4 is connected to the base of transistor Q5 and the emitter of transistor Q5 is connected to the base of transistor Q6. The emitter of transistor Q6 is connected to ground, and the collectors of transistors Q4, Q5 and Q6 are mutually connected to supply voltage terminal 12. The leakage resistors 44 and 46 are included for stability. A NTC reference voltage corresponding to 3 $V_{BE}$ is provided at junction 22 by virtue of the three serially connected emitter-base circuits of transistors Q4, Q5 and Q6.

The overall reference voltage at terminal 24 is thus equal to the sum of the PTC and NTC reference voltages, or $$V24 = 3V_{BE} + I2 * R18,$$

where R18 is the resistance of resistor 18. To ensure a ZTC characteristic for the overall reference voltage Vref, the resistor 18 is sized relative to resistor 40 such that the sum of the PTC and NTC reference voltages (Vref) is equal to three-times the energy band-gap voltage of the semiconductor material used in the manufacture of current mirror transistors Q1 and Q2. In the case of silicon, the energy band-gap voltage is approximately 1.205 V. The values of resistors 36 and 32, in turn, are chosen in relation to the value of resistor 18 to ensure that the supply voltage Vsupply will also have a ZTC characteristic. Specifically, resistors 36 and 32 must be chosen to satisfy the expression:

$$R36=(R32*R18)/[3(R32+R18)]$$

where R32 is the resistance of resistor 32 and R36 is the resistance of resistor 36. The resistor 26, in combination with the chosen values of resistors 32 and 18, determines the supply voltage Vsupply.

In operation, the NTC circuit operates as a gain stage that regulates the supply voltage Vsupply at a value determined according to:

$$V\text{supply}=3V_{BE}+I2*R18+(I1+I2+I3)R26$$

where R26 is the resistance of resistor 26. Any increase in the supply voltage Vsupply increases the bias of the NTC circuit Darlington stage, increasing the current I6 through transistor Q6, and thereby tending to maintain the supply voltage at its nominal value.

The feedback resistor 30 is connected from the base of NTC transistor Q5 to the emitter of PTC bias transistor Q3. Nominally, both terminals of resistor 30 are at the same potential—2 $V_{BE}$. The emitter of bias transistor Q3 is at 2 $V_{BE}$ by virtue of the transistor Q1 and the constant current through identical value resistors 34 and 36. The base of transistor Q5 is at 2 $V_{BE}$ by virtue of the summation of the VBE voltages of transistors Q5 and Q6. Accordingly, feedback resistor 30 has no affect on the circuit operation under nominal operating conditions.

The operation of feedback resistor 30 comes into effect under conditions where the NTC reference voltage provided by NTC circuit 20 varies from its nominal value. This occurs primarily when the current I6 through NTC circuit increases above nominal levels to maintain the supply voltage Vsupply at the nominal regulated value. When this happens, the individual $V_{BE}$ voltages of transistors Q4, Q5 and Q6 increase as well. Ordinarily, this would result in an increase in the overall reference voltage Vref, and thus increase the regulating point of supply voltage Vsupply. However, such a result is avoided with the regulator circuit of the present invention through the operation of feedback resistor 30.

Higher-than-nominal regulating current I6, and the consequent increase in the $V_{BE}$ voltages of transistors Q5 and Q6 causes the potential at the base of transistor Q5 to increase above the potential at the emitter of bias transistor Q3. The increased voltage at the emitter of bias transistor Q3 reduces the current conducted through its collector-emitter circuit, maintaining the current through resistors 34 and 36 at a substantially constant value. This reduces the overall current (I1+I2+I3) drawn by the PTC circuit 16, counteracting the increase in the NTC reference voltage at terminal 22. As a result, the regulating point of the supply voltage Vsupply is maintained more nearly constant, despite the above-nominal regulating current I6.

Ideally, the value of resistor 30 is chosen so that under these conditions, the current through bias transistor Q3 decreases enough so that the voltage across resistor 26 decreases in the same amount that the NTC reference voltage increases. While full cancellation would occur with resistor 30 approximately equal to resistor 26, resistor 30 is preferably slightly higher in resistance that resistor R26 for purposes of circuit stability.

While this invention has been described with respect to the preferred embodiment depicted in the FIGURE, it is expected that various modifications will occur to those skilled in the art. For example, a lower or higher reference voltage could be achieved by decreasing or increasing, respectively, the number of transistors in NTC circuit 20, with appropriate changes to resistor 34. In the case of a lower reference voltage, for example, the transistor Q5 and the resistors 34 and 44 could be eliminated from the circuit. In this regard, it will be understood that circuits incorporating such modifications may fall within the scope of the present invention, which is defined by the appended claims.

The embodiments of the invention in which an exclusive property or privilege is claimed are defined as follows.

We claim:

1. A regulator circuit for a supplied voltage, comprising:

PTC circuit means connected to the supplied voltage via a first divider resistor for establishing a PTC reference voltage based on a $\Delta V_{BE}$ characteristic of first and second transistors having different current densities, the PTC reference voltage appearing across a second divider resistor connected to said first divider resistor, the PTC circuit means including first and second constant current legs including collector-emitter circuits of the first and second transistors, and a third leg having a current source for supplying current to a resistor network including at least a first resistor connected in parallel with a base-emitter circuit of one of the first and second transistors to define a constant intermediate potential;

NTC circuit means having a base-emitter circuit connected to said second divider resistor for establishing a NTC reference voltage which adds to said PTC reference voltage to form an overall substantially ZTC reference voltage at a junction of said first and second divider resistors, the NTC circuit means including a collector-emitter circuit connected to said supplied voltage for shunting current as required to maintain the supplied voltage at a value corresponding to the sum of the overall ZTC reference voltage and a voltage across said first divider resistor; and means coupling the intermediate potential of said PTC circuit to a point in the base-emitter circuit of said NTC circuit having a potential that nominally corresponds to said intermediate potential, such that changes in the current shunted by the collector-emitter circuit of the NTC circuit which change the NTC reference voltage produce counteracting changes in the current supplied by said current source of the third leg of the PTC circuit, thereby to regulate the supplied voltage at a more nearly constant value.

2. The regulator circuit of claim 1, wherein the third leg of said PTC circuit means includes a second resistor connected between said current source and said first resistor, the constant intermediate potential being defined by a sum of voltages across said first and second resistors.

3. The regulator circuit of claim 1, wherein the base-emitter circuit of said NTC circuit comprises a plurality of individual base-emitter circuits connected in series, the potential nominally corresponding to the intermediate potential of said PTC circuit being defined by at least one of said individual base-emitter circuits.

* * * * *